US008070997B2

(12) United States Patent
Guerrini et al.

(10) Patent No.: US 8,070,997 B2
(45) Date of Patent: Dec. 6, 2011

(54) PROCESS FOR THE PRODUCTION OF PIPING MADE OF A CEMENTITIOUS MATERIAL HAVING A CIRCULAR SECTION

(75) Inventors: Gian Luca Guerrini, Milan (IT); Roberta Alfani, Bergamo (IT)

(73) Assignee: Italcementi S.p.A., Bergamo (IT)

( * ) Notice: Subject to any disclaimer, the term of this patent is extended or adjusted under 35 U.S.C. 154(b) by 587 days.

(21) Appl. No.: 12/085,746

(22) PCT Filed: Dec. 6, 2006

(86) PCT No.: PCT/EP2006/011809

§ 371 (c)(1),
(2), (4) Date: Jul. 25, 2008

(87) PCT Pub. No.: WO2007/065699

PCT Pub. Date: Jun. 14, 2007

(65) Prior Publication Data

US 2009/0016828 A1 Jan. 15, 2009

(30) Foreign Application Priority Data

Dec. 9, 2005 (IT) ..... MI2005A2356

(51) Int. Cl.
*D01D 5/24* (2006.01)

(52) U.S. Cl. ..... 264/209.2

(58) Field of Classification Search ..... 264/209.2
See application file for complete search history.

(56) References Cited

U.S. PATENT DOCUMENTS

| | | | | | |
|---|---|---|---|---|---|
| 3,358,342 | A | * | 12/1967 | Spence | 425/262 |
| 3,549,737 | A | * | 12/1970 | Schulze | 264/82 |
| RE27,061 | E | * | 2/1971 | Rubenstein | 156/86 |
| 5,891,374 | A | * | 4/1999 | Shah et al. | 264/108 |
| 6,398,998 | B1 | * | 6/2002 | Krenchel et al. | 264/70 |
| 2007/0181201 | A1 | * | 8/2007 | Baker et al. | 138/113 |

FOREIGN PATENT DOCUMENTS

| | | | |
|---|---|---|---|
| DE | 1220310 | * | 6/1966 |
| GB | 957496 | * | 5/1964 |
| JP | 01-160612 | | 6/1989 |
| WO | WO 93/20990 | * | 10/1993 |
| WO | WO 2005/050079 | * | 3/2007 |

OTHER PUBLICATIONS

PCT Search Report Dated Mar. 29, 2007.

* cited by examiner

*Primary Examiner* — Joseph Del Sole
*Assistant Examiner* — Kimberly A Stewart
(74) *Attorney, Agent, or Firm* — Hedman & Costigan, P.C.; James V. Costigan

(57) ABSTRACT

The present invention relates to a process for the production by extrusion of piping made of a cementitious material having a circular section and fine thickness, suitable for the channeling of liquids and gases at atmospheric operating pressure or slightly higher.

14 Claims, 4 Drawing Sheets

PROCESS FOR THE PRODUCTION OF PIPING MADE OF A CEMENTITIOUS MATERIAL HAVING A CIRCULAR SECTION

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1. Field of the Invention

The present invention relates to a process for the production of piping made of a cementitious material having a circular section.

The present invention derives from the field of extrusion processes of tubular-shaped end-products made of a cementitious material.

In particular, the present invention relates to a process for the production by extrusion of piping made of fibre-cement with a circular section and fine thickness, suitable for the channeling of liquids and gases at atmospheric operating pressure or slightly higher. The present invention also allows the production of end-products with a circular section, for applications in the building and industrial sector such as for example permanent formworks and pillars.

2. Description of Related Art

In the transportation of drinking water, irrigations and wastewater, various types of pipes or ducts are normally used, made of different kinds of materials such as: cementitious materials, plastic materials, concrete, ceramic stoneware and cast iron.

Typical pipes made of cementitious material are pipes made of concrete, reinforced concrete, asbestos cement and fibre-cement without asbestos. The most widely-used plastic materials, on the other hand, are PVC, polyethylene, polypropylene and glass-resin.

As far as the shape of the pipes is concerned, those with a circular section are the most commonly used. There are also however pipes have different shapes from circular, such as for example, circular footrest pipes (flat bottom), elliptic or ovoidal pipes, rectangular pipes, or pipes with other sections specifically designed for favouring the maximum fluid flow in their interior.

The diameters available for the pipes can vary and are divided according to the various types of use.

Another important construction characteristic of these pipes consists of their thickness; those having a so-called "fine thickness", typically have a vacuum percentage of the section higher than 60%.

With respect to processes for the production of piping made of cementitious material, these have been known from the beginning of the last century.

In 1910, W. R. Hume described, in Australian patent 4843/2622, a process for the production of reinforced concrete pipes by means of centrifugation exploiting the centrifugal force. A cylindrical mould with a horizontal axis charged with concrete was rotated at a high velocity, with the removal of the excess water until a compact material was obtained. The so-called "Hume pipes" are still produced, still exploiting the technique based on centrifugation, optionally using reinforced concrete with steel fibres, or other compositions.

Another production technique used in the past is that called "Rotopress" or "Giropress" whereby pipes were produced in vertical, by a rotating mandrel which packed the concrete having a consistency of the humid earth type in an axial direction.

This system has now been substituted by other production technologies such as, for example, the vibrocompression technology, in which dry concrete is again used. In this case, the pipe produced in vertical is immediately removed from the mould and sent to the curing phase.

With the type of production technologies so-far cited, pipes having relatively high thicknesses are obtained, which comply with the European regulation EN 1916 (reinforced concrete, non-reinforced concrete, concrete reinforced with steel fibres).

In addition to concrete pipes, pipes made of fibre-cement having a fine thickness are also known, mainly produced by means of the so-called Mazza process (deriving from the Hatschek technology). In this case, the material used par excellence, was asbestos-cement, recently substituted for environmental reasons by so-called fibre-cement. In the Mazza/Hatschek process, cementitious compositions are used, containing cement, process fibres and reinforcing fibres (both synthetic and natural) and other secondary additives. The products obtained have high mechanical characteristics, they are extremely compact and have low thicknesses.

More recently, the use of the extrusion technology has been proposed, widely used for plastic materials, metals, ceramics, ceramic stoneware and bricks, and also for cementitious materials. The extrusion can be effected with batch or intermittent plug/cylinder systems ("plug extrusion", or "capillary extrusion"), or with continuous screw/cylinder systems. With the exception of ceramic stoneware, in all the other cases the extrusion is carried out horizontally. In the case of ceramic stoneware, in fact, thanks to the high thicknesses of the pipes in relation to their length (normally two meters), there is a rigidity in the fresh state of the pipes which does not cause deformation or distortion.

As far as the extrusion of cementitious materials is concerned, the known art refers to extruders having two consecutive screws, intervalled by a vacuum chamber to facilitate the pressurized extrusion of pastes. These are extruder models normally used in the brick industry.

Extrudable cementitious compositions for the production of pipes made of cementitious materials are described in U.S. Pat. No. 3,857,715 issued in 1974 in the name of C. W. Humphrey, and U.S. Pat. No. 5,047,086 issued in 1991 in the name of K. Hayakawa et al.

The U.S. Pat. No. 5,658,624 of 1997 in the name of Anderson et al. describes compositions and methods for producing a variety of articles based on extrudable hydraulic cement.

U.S. Pat. No. 5,891,374 of 1999 of Shah et al., which describes the extrusion of reinforced-fibre products, is also known.

U.S. Pat. No. 6,309,570 of Fellabaum et al. describes a vacuum system for improving the extrusion of cementitious products, without referring however to tubular products.

The extrusion of a reinforced-fibre with a pseudoductile behaviour for the production of low-thickness pipes, is also known from international patent application WO 2005/050079. This international patent application makes reference to a particular extrusion technique previously described in U.S. Pat. No. 6,398,998 B1 which does not exploit the screw system for the extrusion phase, but a water suction method from a liquid reinforced-fibre cementitious formulation, introduced under pressure into a kind of coaxial cylinder. After the water extraction, the material is formed at a high pressure, obtaining pipes having a particularly fine thickness with extremely valid mechanical properties, in terms of ductility.

The US patent application 2004/0075185 A1 di Dugat et al. which relates to a plug moulding system of a high performance cementitious material for producing sewage pipes with a medium-high thickness, is also known. The technology described is also known by the name of Tetris or Evolit.

The technologies for the production of pipes made of cementitious material however are not without processing drawbacks.

One of the main problems which arise in production techniques by extrusion of cement-based pipes, is represented by maintaining the circular form at the outlet of the die.

Pipes produced by extrusion have the problem at the outlet of the die of maintaining their form as, due to their weight and low thickness, they bend over themselves losing their circular shape.

The lower the thickness of the extruded profile and with high vacuum percentages of the end-product the more significant this technical problem becomes.

The "vacuum percentage" refers to the percentage ratio between the empty surface and the full surface of the tubular product. The greater this percentage, especially in the presence of large dimensional end-products, the more critical the problem of maintaining the form becomes.

This problem is not limited to the field of cement-based pipes but also relates to pipes made of plastic materials such as for example PVC and PE pipes. In the field of plastic materials, the problem has at least been partially overcome by passing the pipe into a cooled calibrator which, by causing the rapid hardening of the plastic, also ensures its circular form.

This technical solution however can only be applied to plastic materials because, as these are extruded at high temperatures, their cooling causes hardening consolidating their shape.

On the contrary, the technical problem of maintaining the circular shape remains unsolved in the field of end-products and cement-based pipes as, contrary to what occurs for plastic materials, the extrusion is carried out under thermo-controlled conditions.

The problem of preserving the form for fibre-cement pipes having a low thickness is further increased by the high market demand for this type of fine piping. A greater vacuum percentage of the pipe section does in fact correspond, with the same nominal diameter, to a greater lightness of the pipe and consequently a lower cost per linear meter of the end-product.

Under normal extrusion process conditions, however, the fine thickness of the pipe can cause a loss in its circularity which, on the other hand, must be guaranteed in the hardened product to allow its final acceptability.

In the field of the invention, this characteristic is also defined as the "green strength" of the extruded product, or also "form stability".

"Green strength" or "form stability", in the present invention relate to the capacity of the neo-extruded end-product of maintaining its own shape (or geometry) immediately after leaving the extruder die.

This concept is widely described in U.S. Pat. No. 5,658,624, mentioned above with reference to the extrusion of pipes.

The possibility of obtaining an adequate green strength of the extruded product is typically related to various composition or process parameters, such as: compactness of the solid components; the low water/solid ratio of the paste also correlated with the mechanical resistance of the material; the extrusion pressure; the possibility of using a heated die; the possibility of using chemical compounds capable of being thermally activated to harden the outgoing material.

It should also be noted that the problem relating to the difficulty of preserving the form does not even allow tubular end-products having an adequate length to be obtained.

A further development of the above patent is represented by the process described in U.S. Pat. No. 5,545,297 in which a complicated mechanical system for continuous filament winding is introduced downstream of the die, for obtaining pipes with a high resistance and low thicknesses. The winding system also allows more rigid pipes to be obtained which preserve their circular form. The system described however is somewhat complex and expensive and does not adequately solve the problem.

Another document which refers to maintaining the circular form of extruded pipes consists of international patent application WO 2005/050079 A1 in the name of Rocla Pty Ltd. This describes the production of fibre-cement pipes having a low thickness, by means of a particular dewatering extrusion process which comprises eliminating the water from the material during extrusion. The level of the final water/binder ratio is in the order of 0.20, congruent with what is indicated in literature, for obtaining adequate mechanical resistance and therefore, in this case, high performance pipes with a low thickness.

Not even in this case however is the problem of maintaining the circularity after extrusion satisfactorily solved, as in the description it is stated that a substantially constant section of pipe length, not necessarily circular, is accepted.

In the current state of the art, the technical problem of the bending of fibre-cement pipes at the outlet of the extrusion die, which occurs as a result of their weight and fine thickness, has consequently remained unsolved.

BRIEF SUMMARY OF THE INVENTION

One of the objectives of the present invention therefore consists in providing a process for the production of piping made of cementitious material having a circular section which allows to maintain substantially the form of the end-product immediately after the extrusion phase.

A further objective of the present invention consists in providing a process which allows the production of piping made of fibre-cement with a fine thickness which stably preserves its circular form after extrusion.

Another aspect of the present invention consists in providing a method for preserving, at the outlet of the die, the circular form of the fibre-cement piping produced by extrusion.

In view of the above objectives, according to a first aspect of the invention, a process is provided for the production of a piping made of cementitious material having a circular section by a process characterized in that it comprises a rolling phase where neo-extruded piping is rolled inside a tubular mould that transmits centrifugal force to the neo-extruded piping which preserves the circular form of said neo-extruded piping until a hardening degree of the cementitious material is obtained, said rolling phase of said neo-extruded piping comprising rotating said neo-extruded piping in alternating directions.

Further accessory characteristics of the process of the invention are set forth herein.

DETAILED DESCRIPTION OF THE INVENTION

According to an aspect of the process of the invention, the cement-based end-product or piping having a circular geometry is subjected after extrusion to rolling by rotation inside a tubular counter-mould.

The rolling movement phase, suitable for maintaining the circularity of the piping, is conveniently effected in an alternating direction and prolonged until a hardening degree is reached, which ensures the preservation of the circular form.

In an embodiment of the process of the invention, the moving phase begins at the outlet of the extruder and comprises the rotation of the piping in an alternating direction in a tubular counter-mould, conveniently positioned directly in contact with the extruder die. The piping leaving the die, therefore finds a tunnel, consisting of the counter-mould, in which it passes for a pre-established length until the cutting phase and subsequent transferal.

Said counter-mould is typically a pipe having a circular section made of a metallic or plastic material, for example PVC or PE.

The neo-extruded pipe made of cementitious material is capable of passing through this mould without the help of pullers and/or external movements, for example for lengths up to 6 meters, partly adhering to the walls of the mould, especially below.

According to an embodiment, once the desired length has been reached, the piping-tubular counter-mould system is cut and sent to a rotating roll system in an alternating direction.

During the passage phase of the pipe in the counter-mould and also subsequently in the cutting and moving phases, before the rolling phase, which can typically last for up to 30 minutes after extrusion, the extruded pipe has a deformed geometry with a loss of its circular form. As hardening phenomena of the cement-based material, however, have not yet intervened, thanks to the high processability of the latter, the rolling phase allows the perfect recovery of the circular form.

The hardening starting time of the cement-based material is variable and is typically about 2 hours after extrusion.

The piping-tubular counter-mould combination is conveniently maintained in alternating rotation at a rate conveniently ranging from 0.2 rpm to 10 rpm for a time varying from 2 to 5 hours depending on the dimensions of the pipe.

For rolls of an anti-ovalization roller having a diameter of 220 mm, the velocity range is preferably from 0.4 to 7.5 rpm, more preferably from 0.4 to 2 rpm, until a hardening degree is reached which is such as to ensure the preservation of the form.

In order to extract the extruded pipe, it must be rigid, even if its rigidity does not coincide with the end of the dehydration process of the cement, but reaching a rigidity degree which is such as to allow it to be moved without causing significant deformation.

For example, in relation to the temperature and humidity conditions which can be applied during the rolling phase the hardening of the pipes can take place within a time conveniently ranging from 30 minutes to 3 hours, more preferably from 1 to 2 hours.

The cement pipe is then extracted from the tubular counter-mould and sent to the final curing system.

The diameter of the counter-mould, which must be greater than the outer diameter of the extruded pipe, is advantageously not excessively greater than the extruded piping in order not to jeopardize the final performances of the end-product. It has been observed that it is preferable to have a tolerance for the counter-mould with respect to its inner diameter ranging from 0.4 to 3% and more preferably from 0.8 to 2% more with respect to the outer diameter of the extruded pipe.

The process of the invention allows pipes to be obtained, having a regular circular form, with a typical length of up to three meters, practically without cracks caused by shrinkage or mechanical stress, with high mechanical performances.

According to an embodiment, the process of the invention envisages the use of an automatic calibration plant comprising a series of calibrating moulds in order to increase the production rates and reduce the withdrawal times from the counter-mould.

In particular, the cement pipe leaves the extruder and advances, passing into the first calibrator of a pre-established length; said calibrator is supported by a series of wheels which transmit a self-rotating movement. When the pipe has reached the end of the calibrator, it is cut and the calibrator begins to rotate at a rate conveniently varying from 1 to 100 rpm, preferably from 5 to 75 rpm, more preferably from 10 to 30 rpm. The rotation transmits a centrifugal force to the cement pipe and compels it to adhere to the walls of the calibrator, maintaining its circular form.

In an embodiment of the invention there is a heating system on the outside of the calibrator which, by heating the cement end-product, accelerates the hardening process, an example of such a heating system being at least one infrared-ray irradiator. During this time, the first calibrator is moved from the drawplate, leaving room for a second calibrator in front of the extruder head to receive the second pipe; the same occurs for the other calibrators present.

According to an embodiment, at the end of the transporting chain there is an extraction system comprising a pressurized cylinder for extracting the rigid pipe; a catenary system then conveys the empty calibrator downstream of the extruder to repeat the cycle.

This system is extremely versatile, in relation to the diameters to be obtained as it consists of interchangeable moulds of various sizes positioned inside the calibration plant.

According to another embodiment of the process of the invention, after hardening, the pipes are subjected to a final curing cycle which can consist either of treatment with water, at either room temperature or under heating, preferably not higher than 80° C., or of treatment in static climatic chambers and/or in tunnels on line under controlled temperature conditions, preferably at a maximum temperature of 50° C., and humidity.

The piping obtained with the process of the invention is based on cementitious material or fibre-cement, the latter term comprising materials based on cement containing reinforcing fibre of the natural or synthetic type.

The process of the invention is particularly suitable for the production of pipes with a circular geometry and fine thickness, typically having a percentage of empty section higher than 60%, preferably higher than 70%.

A higher vacuum percentage corresponds, with the same nominal diameter, to a greater lightness of the pipe which, for a same malt in fibre-cement composition, in turn corresponds to a lower cost per linear meter of product, as indicated in Table 1.

TABLE 1

| Nominal diameter mm | THICKNESS (mm) 10 | 12 | 14 | 16 | 18 | 20 | 24 | 28 |
|---|---|---|---|---|---|---|---|---|
| 150 | 78% | 74% | 71% | \ | \ | \ | \ | \ |
| 200 | 83% | 80% | 77% | 74% | 72% | 70% | \ | \ |
| 250 | \ | \ | 81% | 79% | 76% | 74% | 70% | 67% |
| 300 | \ | \ | \ | 82% | 80% | 78% | 74% | 71% |
| 400 | \ | \ | \ | \ | \ | 83% | 80% | 77% |

The fine thickness referred to in this case is, for the same nominal diameter, lower than that of a pipe made of reinforced or non-reinforced concrete, of the traditional type, or ceramic stoneware.

This value is very close to that of pipes made of asbestos-cement, no longer in use, which, however, have mechanical performances which, on an average, are still higher than those made of fibre-cement without asbestos.

The process of the invention typically allows an end-product having a circular section to be obtained, such as pipes, joints and accessories for gravity systems according to the regulation UNI EN 588-1 and for discharge systems for buildings in accordance with the regulation UNI EN 12763.

The pipes having a circular section obtained with the process of the invention are used in numerous applications sectors, for example in discharge systems, such as sewage disposal, or in drainage systems, and also in pressurized applications or in other types of liquid or gas channeling, at atmospheric operating pressure or slightly higher, or as permanent formworks, for the construction of circular pillars or other cylindrical elements for the building industry.

BRIEF DESCRIPTION OF THE SEVERAL VIEWS OF THE DRAWINGS

The characteristics and advantages of an embodiment of the process for the production of piping having a circular section made of cementitious material, according to the present invention, will appear more evident from the following illustrative and non-limiting description referring to the enclosed schematic drawings, in which:

With reference to FIG. 1, this schematically illustrates the preliminary phases of an embodiment of the process 1 for the production of piping having a circular section made of cementitious material. A mixer 2 is fed with:

Figure 1:
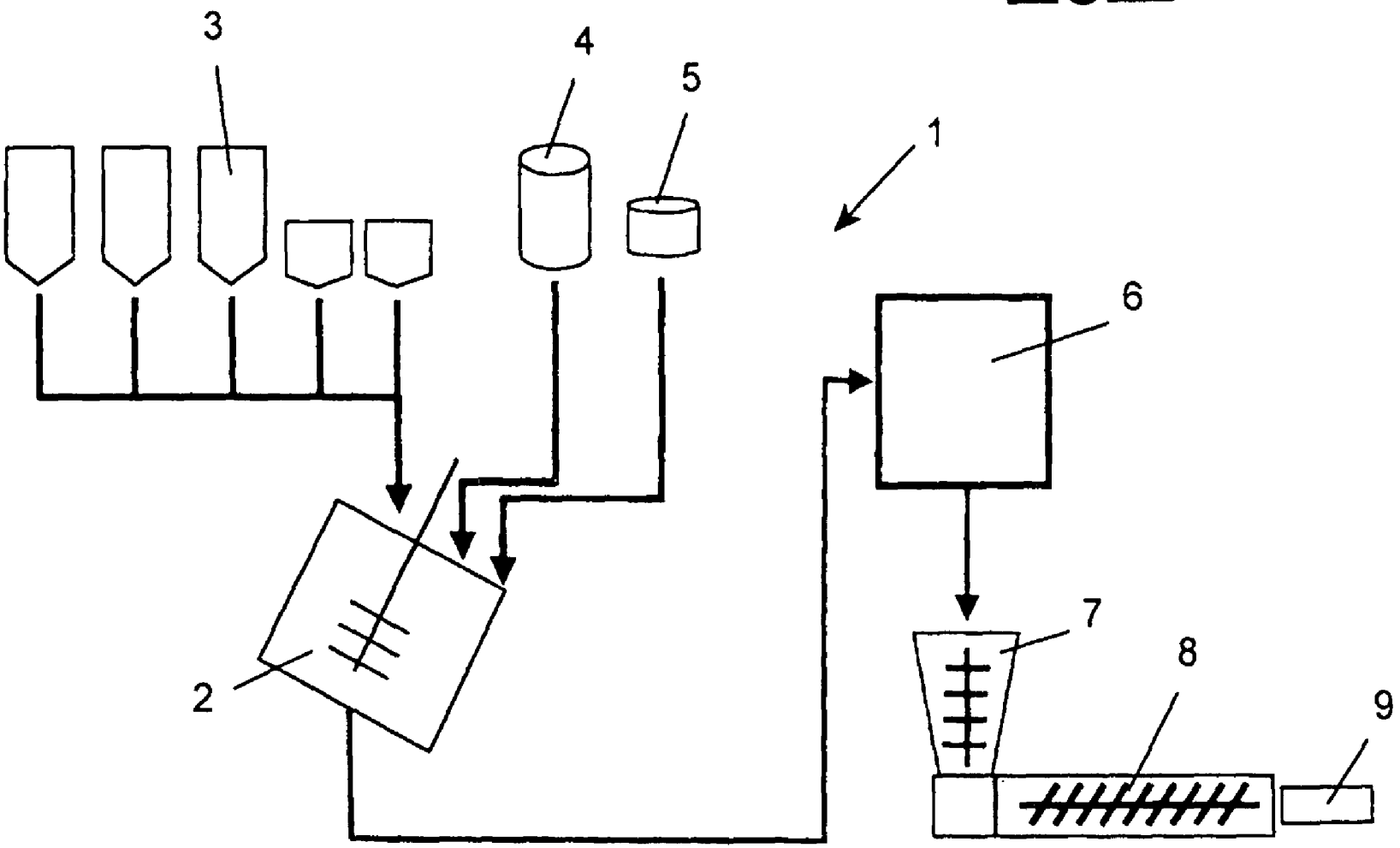
FIG. 1 is a schematic representation of an embodiment of a process for producing a pipe having a circular section according to the invention.

- a solid cement-based component, which typically comprises one or more components selected from cement, sand, aggregates, fillers of a mineral or pozzolanic origin, various types of fibres such as polymeric, metallic, glass, carbon fibres and viscosizing additives, stored in a series of hoppers, 3 preferably of the gravimetric type,
- water 4, stored in a hopper for liquids 4,
- additives 5, conveniently fluidizing agents stored in a separate hopper 5.

The components in solid phase are then mixed in a mixer typically of the intensive type 2 for a time preferably ranging from 1 to 5 minutes, in relation to the characteristics of the mixer and outside temperature until a homogeneous mixture is obtained. The liquid components, comprising water, are then added, and the mixing is prolonged for a time typically ranging from 1 to 5 minutes in relation to the characteristics of the mixer and outside temperature.

At the end of the mixing phase the mixture can be in different semi-solid forms varying from wet powder to small pellets or in the form of a paste. The system thus obtained is preferably collected in an intermediate collection box, before being sent by transporting means to a pasting machine or homogenizing mixer 6.

This apparatus 6 has the function of transforming the wet powder, obtained in the mixing phase, into a paste by the application of a high shear stress.

The passage of the cement-based material through this apparatus 6 improves the extrusion phase of the paste having a low water content.

According to an embodiment, the semi-fluid system obtained in the form of a paste is collected in a box and sent on belts for feeding an extruder. The extruder is preferably of the twin-screw type in series, for example of the type produced by the company Haendle. The twin-screw extruder is equipped for example with two screws arranged orthogonally with respect to each other, of which the second screw 8, which is horizontal, typically having a diameter of 350 mm, is suitable for compacting the material also at high pressures. Said extruder is particularly suitable for high viscosity materials and which produce considerable friction as cementitious materials. The first screw, 7, which is vertical, is used for the loading of the material, the second horizontally 8 for the actual drawing phase and, in correspondence with the drawplate, a typical maximum internal pressure of 50 bars can be reached, preferably about 40 bars; between the two areas, there is a chamber for creating a vacuum in order to obtain the maximum compacting of the material for a good surface finishing of the end-product.

The extrusion phase is preferably effected under controlled temperature conditions, typically below room temperature, by means of a cooling system, to ensure a good processability of the pastes thus slowing down the hydration kinetics of the cement.

Under these conditions (diameter of the second screw 350 mm) it is possible for example to extrude pipes having an internal diameter, also called nominal diameter (ND) according to UNI EN 588-1 and UNI EN 12763 ranging from 150 mm to 350 mm, a thickness ranging from 10 to 22 mm and a length varying from 1 to 5 meters.

Typically, the pipe leaving the extrusion die passes into a circular mould made of a plastic or metallic material 9, conveniently positioned in contact with the die of the extruder. Once the desired length has been reached, the extruded substrate is cut and sent, with its mould, to a roll system rotating in an alternating direction. After hardening, the pipes obtained can be subjected to a final curing cycle for example by treatment with water at room temperature or heated, or for treatment in static climatic chambers and/or in tunnels on line with controlled temperature (maximum 50° C.) and humidity conditions. The pipe is subsequently sent to the final storage phase.

Figure 2:
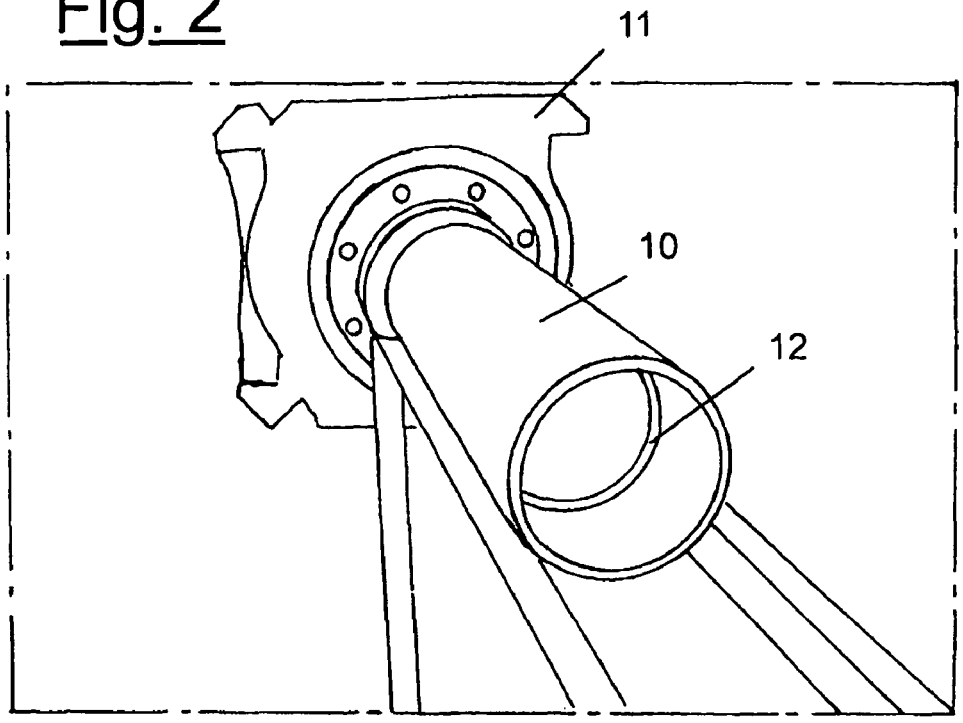
FIG. 2 illustrates an embodiment of an extrusion phase of a pipe made of fibre-cement inside a counter-mould.

FIG. 2 illustrates a tubular counter-mould 10, situated directly in contact with the die of an extruder 11. The neo-extruded tubular end-product 12 leaving the die of the extruder 11 is conveyed into the tubular counter-mould 10. The pipe 12 made of a cementitious material passes through said mould 10 without the help of pullers and/or external moving and after reaching the desired length, the pipe is cut and sent with its mould 10 to a pipe moving system by means of rotation.

Figure 3:
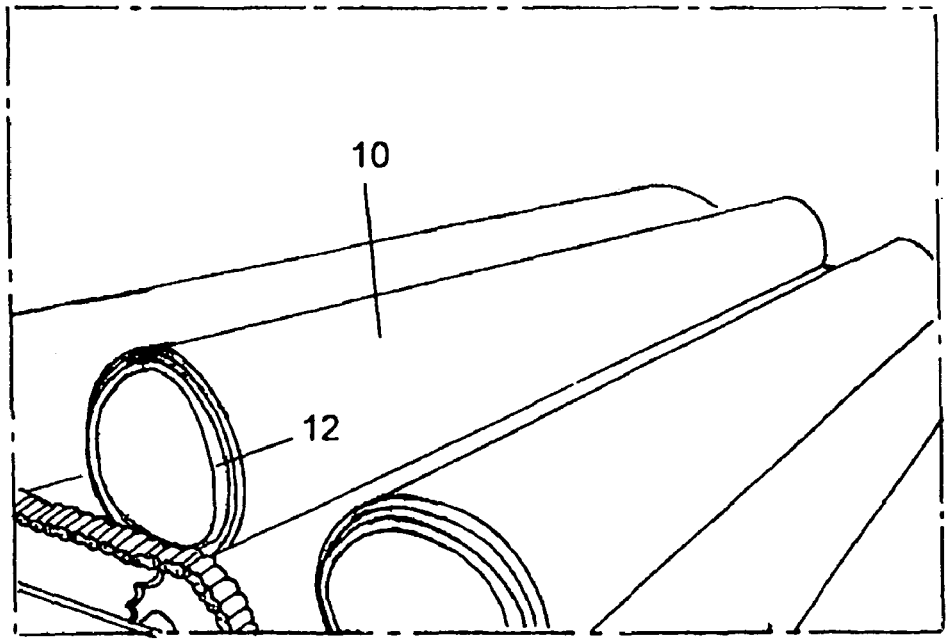
FIG. 3 illustrates a roll moving system of the combined piping-tubular counter-mould unit, FIG. 4 schematically illustrates an anti-ovalization roll with hot air flow lines.

FIG. 3 illustrates an embodiment of the rolling phase of the process of the invention which utilizes a roll moving system of the combined piping-tubular counter-mould unit. This phase is preferably initiated within 30 minutes of extrusion. As hardening phenomena of the material have not yet taken place, thanks to its high processability, the rolling phase on rolls allows the perfect recovery of the circularity of the extruded product. The combination of piping 12—counter-mould 10, is kept in alternating rotation at a minimum rate of 0.2 rpm and a maximum rate of 10 rpm (for rolls of the anti-ovalization roller having a diameter of about 220 mm—this velocity range can vary in relation to the diameter of the calibrator rolls and distance of the axes of the rolls themselves) for a time conveniently varying from 2 to 3 hours, until a hardening degree is reached, which is such as to ensure the preservation of the circular geometry of the piping.

Figure 4:
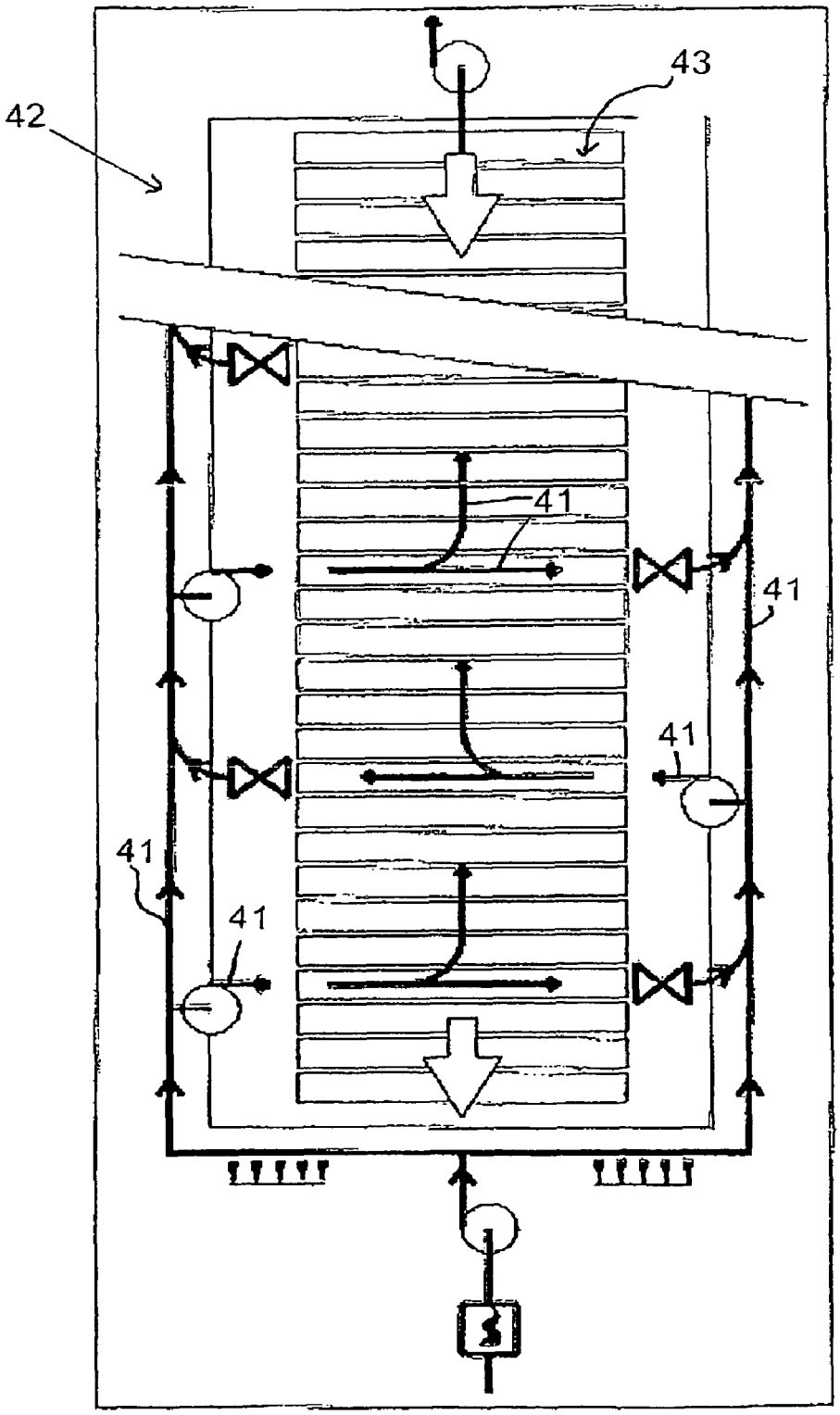
Figure 5:
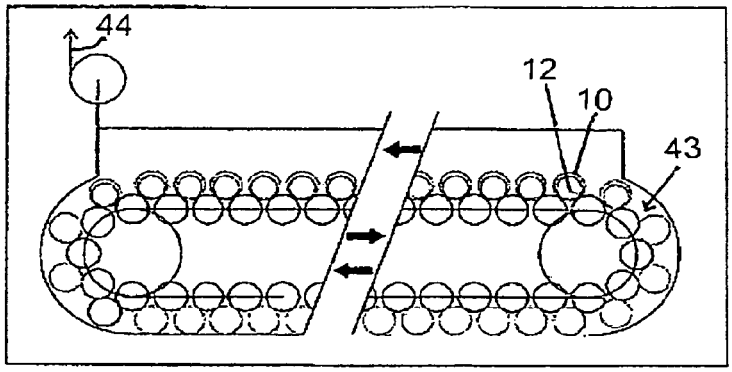
FIG. 5 schematically illustrates a mould supply system downstream of the extruder.

With reference to FIGS. 4 and 5 , these schematically show the functioning with the hot air flow lines 41 of an embodiment of the rolling system 42 adopted b an anti-ovalization roller and also the supply system 43 of the moulds downstream of the extruder. This system allows pipes having a regular circular form to be obtained, and a of up to three meters, without cracks due to shrinkage or mechanical stress, with final mechanical performances about 50% higher than the value obtained with the use of the methods of the known art.

Figure 6:
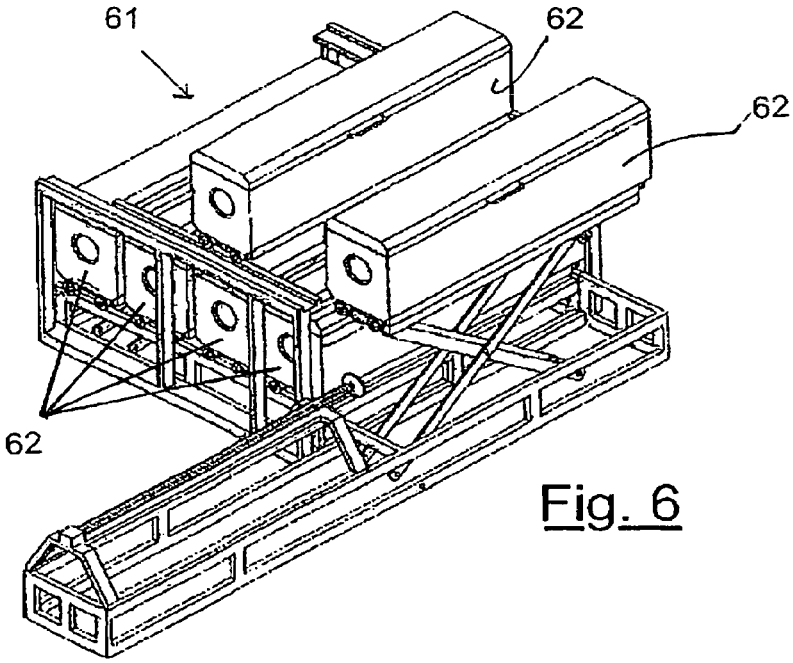
FIG. 6 illustrates an automatic calibration plant comprising 6 calibrator moulds.

FIG. 6 illustrates another embodiment of the system illustrated in FIGS. 4 and 5 which envisages an automatic calibration plant 61 comprising a series of calibrator moulds 62. In particular, an automatic calibration plant 61 is shown, comprising 6 calibrator moulds 62. This number of calibrators is purely illustrative as it is associated with the hourly productivity of the extrusion plant.

The cement piping leaves the extruder and advances, passing into the first calibrator 62 of a pre-established length; said calibrator 62 is supported by a series of wheels which transmit a self-rotation movement. When the piping has reached the end of the calibrator, it is cut and the calibrator begins to rotate at a varying rate, for example from 1 to 100 rpm, preferably from 5 to 75 rpm, more preferably from 10 to 30 rpm. The rotation transmits a centrifugal force to the cement pipe which compels it to adhere to the walls of the calibrator, maintaining its circular form.

In an embodiment, a heating system is positioned on the outside of the calibrator, which, by heating the cement product, accelerates the hardening process. During this time, the first calibrator is moved from the draw-plate, leaving room for a second calibrator in front of the extruder head to receive the second pipe; the same occurs for the other 4 calibrators present. At the end of the transporting chain, there is conveniently an extraction system with a pressurized cylinder for extracting the rigid pipe; a catenary system then takes the empty calibrator back downstream of the extruder to repeat the cycle.

This system is extremely versatile, in relation to the diameters to be obtained as it consists of interchangeable moulds of various sizes situated inside the calibration plant.

The following example is provided for purely illustrative purposes of the present invention and should not be considered as limiting its protection scope, as indicated in the enclosed claims.

EXAMPLE

Pipes were produced with the process according to the invention, all corresponding to the geometrical and performance requisites required by the regulation UNI EN 588-1 and UNI EN 12763. The pipes had an average thickness of 12.5 mm (DN 200 mm per pipe). The tolerances with respect to the internal diameter abundantly fall within those specified by the regulation UNI EN 588-1 for DN<1200 (<4.5 mm). The pipes thus produced had crush resistance values of 25 KN/ml above the value indicated for said diameters (DN 200 mm), respectively 18 KN/ml for pipes of group 90 (load for unitary internal surface 90 $KN/m^2$) and 24 KN/ml for group 120 of greater commercial interest.

The invention claimed is:

1. A process for the production of piping made of cementitious material having a circular section and a low thickness by the extrusion of a cement-based paste to form neo-extruded piping, characterized in that it comprises a rolling phase of wherein the neo-extruded piping is rolled inside a tubular counter-mold transmitting centrifugal force to said neo-extruded piping which preserves the circular form of said neo-extruded piping until a hardening degree of the cementitious material is obtained, said rolling phase of said neo-extruded piping comprising rotating said neo-extruded piping in alternating directions.

2. A process for the production of piping made of cementitious material having a circular section and a low thickness by the extrusion of a cement-based paste to form neo-extruded piping, characterized in that it comprises a rolling phase wherein the neo-extruded piping is rolled inside a tubular counter-mold transmitting centrifugal forces to the neo-extruded pipe which preserves the circular form of the neo-extruded piping until a hardening degree of the cementitious material is obtained wherein the neo-extruded piping and tubular counter-mould are kept in alternating rotation at a rate ranging from 0.2 rpm to 10 rpm.

3. The process according to claim 1, characterized in that said counter-mould has a tolerance with respect to its internal diameter ranging from 0.4 to 3% more with respect to the external diameter of the neo-extruded piping.

4. The process according to claim 1, characterized in that said rolling phase is effected for a period of time ranging from 30 minutes to three hours.

5. The process according to claim 4, characterized in that said rolling phase comprises a curing phase of the piping.

6. The process according to claim 1, characterized in that said piping with a circular section has a vacuum percentage of the section higher than 60%.

7. The process according to claim 6, characterized in that said vacuum percentage of the section is higher than 70%.

8. The process according to claim 1, characterized in that said piping is made of fibre-cement.

9. The process according to claim 1, characterized in that said tubular counter-mold comprises at least one automatic calibration device comprising at least two calibrator moulds.

10. The process according to claim 9, characterized in that said automatic calibration device comprises heating means for directly heating the calibrator mould containing the extruded cement end-product.

11. The process according to claim 10, characterized in that said heating means comprise at least one infrared-ray irradiator.

12. The process according to claim 9, characterized in that the combination of neo-extruded pipe and said calibrator mould is kept in rotation at a rate ranging from 1 rpm to 100 rpm, preferably from 5 to 75 rpm.

13. A piping made of cementitious material having a circular section and a low thickness obtained with the process according to claim 1.

14. A process for the production of an end-product made of cementitious material having a circular section and low thickness comprising:

a mixing phase of a cement-based mixture with water to give a wet cement-based powder;

a homogenization phase of said wet cement-based powder in a pasting machine to produce a cement-based paste suitable for extrusion;

an extrusion phase of said cement-based paste in an extruder to give a cement-based end-product having a substantially circular section;

a flowing phase of said cementitous end-product having a substantially circular section inside a tubular counter-mold positioned close to the die of the extruder to form a combination of an end-product-tubular-counter-mold;

a cutting phase of said end-product-tubular-counter-mold system;

a rolling phase of the end-product-tubular-counter-mold system transmitting a centrifugal force to the end product where said rolling phase of said end-product-tubular-counter-mold comprises rotating said end product inside of the tubular counter-mold in alternating directions which allows the circular form of the product to be preserved until a hardening degree of the cementitious material is reached.

* * * * *